US005564103A

United States Patent [19]

Gagel

[11] Patent Number: 5,564,103

[45] Date of Patent: Oct. 8, 1996

[54] REDUCING THE VOLUME OF DEPLETED ION EXCHANGE BEAD RESIN

[75] Inventor: Donald F. Gagel, Knoxville, Tenn.

[73] Assignee: Westinghouse Electric Corporation, Pittsburgh, Pa.

[21] Appl. No.: 381,622

[22] Filed: Jan. 30, 1995

[51] Int. Cl.[6] ..... G21F 9/00

[52] U.S. Cl. ..... 588/20; 210/651; 976/DIG. 380

[58] Field of Search ..... 588/6, 20; 264/0.5; 976/DIG. 394, DIG. 380; 210/651

[56] References Cited

U.S. PATENT DOCUMENTS

| | | | |
|---|---|---|---|
| 4,452,733 | 6/1984 | Horiuchi et al. | 252/632 |
| 4,582,099 | 4/1986 | McDaniel et al. | 141/65 |
| 4,762,647 | 8/1988 | Smeltzer et al. | 252/632 |
| 4,834,914 | 5/1989 | Jackson | 588/6 |
| 4,836,937 | 6/1989 | Homer | 210/808 |
| 4,952,339 | 8/1990 | Temus et al. | 252/632 |
| 5,022,995 | 6/1991 | Roy et al. | 210/651 |
| 5,143,615 | 9/1992 | Roy et al. | 210/350 |
| 5,164,123 | 11/1992 | Goudy, Jr. | 588/6 |
| 5,242,503 | 9/1993 | Grant et al. | 134/25.1 |

*Primary Examiner*—Ngoclan Mai
*Attorney, Agent, or Firm*—Daniel P. Cillo

[57] ABSTRACT

A process for removing liquid from depleted ion exchange bead resin includes the steps of: transferring a slurry containing at least 10 volume % of contaminated ion exchange resin beads from storage (10) having a particle size range from 300 micrometers to 1000 micrometers to a blending tank (14) to provide a homogeneous slurry which is fed to a grinder (16) usually by means of pumps (13 and 17), where the beads are fractured, and reduced in size, where no more than 33% of the fractured beads have a relatively similar diameter, allowing subsequent random packing compression; and then passing the processed slurry to a dewatering system (18) where it is separated into liquid (20) and highly compressible waste (22).

10 Claims, 1 Drawing Sheet

REDUCING THE VOLUME OF DEPLETED ION EXCHANGE BEAD RESIN

BACKGROUND OF THE INVENTION

This invention relates to a method of providing a compressible slurry of contaminated, ion exchange bead resin, in the process of compression dewatering of such materials, prior to storage as solid waste.

Storage of nuclear contaminated wastes presents many problems. Naturally, if the waste can be compacted substantially, less burial space will be required. Such compaction can be easily handled for solids.

In the area of liquid type waste, radioactive slurries generated by nuclear reactor power plants, governmental operations, hospitals and the like must be disposed of at burial sites licensed by the U.S. government. Often these wastes are in the form of spent ion-exchange bead resins, spent ion exchange powdered resins, filter media, waste sludge, chemical precipitates, and similar granular-type slurry media which result from water treatment processes in the facilities generating the wastes. The use of ion exchange resins to capture a wide variety of metals, such as Pb, Rb, Cs, Ba, Sr, is taught in U.S. Pat. No. 5,242,503 (Grant et al.).

In nuclear reactor power plants, the liquid moderator circulating through the reactor typically contains dissolved and suspended radioactive solids. These solids usually are fission and corrosion products formed in the plant piping system and plant equipment through which the moderator circulates. The radioactive liquid moderator should be kept reasonably free from such fission and corrosion products during plant operation because the radiation fields surrounding the reactor have to be maintained at a low level for health reasons. Therefore, the liquid moderator is typically recirculated and filtered through ion exchange resin beds to remove the dissolved and suspended radioactive solids.

An ion exchange resin is usually a synthetic material or a natural or synthetic mineral that adsorbs an ion from solution in exchange for a less strongly held ion such as a sulfonic, carboxylic, phenolic, or substituted amino group that previously formed part of the structure of the resin. The ion exchange material can be in spherical "bead" form, usually 300 micrometers to 1000 micrometers diameter or finer "powdered" form, usually 10 micrometers to 400 micrometers diameter. After the accumulation of radioactive material in the resin bed reaches a predetermined level, the resin is typically removed for transport to an appropriate disposal site. However, such spent ion exchange resin bead slurry or spent ion exchange resin powder slurry contains a substantial amount of water and accumulated radionuclides. Some of these radionuclides may have a half-life of several hundred years and therefore should be isolated until the radiation emitting from the radionuclides has decreased to an acceptable level.

Burial of such low-level radioactive slurries is a relatively inexpensive means for isolating the radio-nuclides and for providing adequate long-term shielding. However, such burial raises the possibility of leaching by water and the possibility of contamination of nearby ground water. Therefore, when burial is used as means for waste disposal, it is desirable to eliminate water from the waste to reduce its volume and to compact the waste in waterproof and generally leak-tight containers before burial to reduce the risk of contamination of nearby ground water.

In the area of dry compaction, U.S. Pat. No. 4,452,733 (Horiuchi et al.), relating to contaminated slurries of ion exchange resins, teaches drying and milling the resins in a centrifugal membrane drier to provide dry contaminated resin and evaporated steam. Also, U.S. Pat. No. 4,762,647 (Smeltzer et al.), discloses treating low level radioactive contaminated slurry mixtures of ion exchange powder or ion exchange beads with 40 weight % to 70 weight % cellulose filter aid, by removing all the water from the mixture and then compacting at 141 kg/cm$^2$ (2,000 psi) and 230° C., to form a sintered monolith.

An apparatus for removal of liquid from a waste burial container holding a slurry of waste material, without first drying, is taught by U.S. Pat. No. 4,582,099 (McDaniel et al.). In U.S. Pat. No. 4,836,937 (Homer), contaminated, spent, ion-exchange resin powder slurries were dewatered without any initial drying. Here, the powder slurry was directly passed into a vessel containing filters and a bag of pliant material which, when the vessel was evacuated, could compress the ion exchange powder against the filters. In this regard, U.S. Pat. No. 4,952,339 (Temus et al.) taught that 40 to 50% volume reduction, involving complete water removal from contaminated ion exchange resins, could cause burial containers to burst due to ion exchange resin swelling caused by ground water leakage into the container. There ion exchange resins were not dried beyond their burial equilibrium endpoint so that only enough water was removed to equal saturated conditions experienced by the resin at its burial temperature. These dewatering methods were improved upon in U.S. Pat. Nos. 5,022,995 and 5,143,615 (both Roy et al.) which teach 20 to 30 volume % reduction dewatering of contaminated ion exchange powder material, filter media, waste sludge, and other granular type slurries by compression as well as suction.

What is needed is a method to economically treat, in a continuous fashion and without the expensive steps of first drying and handling contaminated vapor, liquid slurries of the larger, contaminated, depleted, ion exchange resin beads, which appear incompressible in large measure. Thus, the invention of this application relates primarily to reducing the volume of resin beads rather than already size reduced resin powder. It is one of the main objects of the invention to provide such a method and apparatus.

SUMMARY OF THE INVENTION

Accordingly, the invention broadly resides in a process of reducing the volume of contaminated, depleted ion exchange resin beads, where a substantial amount of the beads have a relatively similar diameter, by contacting the beads with an amount of water effective to maintain a steady, predetermined volume % concentration range of resin beads and provide a homogeneous slurry, and then feeding the slurry to a grinder and grinding the slurry to provide a wide particle size distribution of fractured beads where no more than 33% of the fractured beads in the slurry have a relatively similar diameter, and then dewatering the slurry. The invention also more specifically resides in a process of reducing the volume of solids feed, containing contaminated, depleted ion exchange resin beads, characterized by the steps of: (a) transferring a feed slurry, containing at least 10 volume % of contaminated, depleted ion exchange resin beads, having a particle size range from 300 micrometers to 1000 micrometers diameter, where at least 20% of the beads in the slurry have a relatively similar diameter, to a blending tank; (b) feeding an amount of water into the blending tank effective to maintain a steady, predetermined volume % concentration range of resin beads for passage to a grinder and to provide a relatively homogeneous slurry; (c) grinding the slurry including the beads in an enclosure in a manner effective to contain airborne contamination and to provide a wide particle size distribution of fractured beads, from 10 micrometers to 1000 micrometers diameter, where no more than 33% of the fractured beads in the slurry have a relatively similar diameter, to provide a processed slurry, and allowing subsequent random packing of the processed slurry upon compression; and (d) dewatering the processed slurry.

Preferably the passage to the grinder will be by pumping, the packing factor of the processed slurry after grinding will range from 0.62 to 0.93 from an initial unground range of from 0.50 to 0.60, and after dewatering there will be at least a 20 volume % reduction in the final waste volume. The preferred dewatering process includes a vacuum pump for applying a vacuum to a suitable filter and collapsible membrane combination in which the processed slurry is contained. The contaminated material contained in the depleted ion exchange material can be metals such as Pb, Rb, Cs, Ba, Sr, U, or toxic substances such as polychlorinated biphenyls (PCB's), pentachlorophenol (PCP's), and the like, or their mixtures.

BRIEF DESCRIPTION OF THE DRAWING

In order that the invention can be more clearly understood, convenient embodiments thereof will now be described, by way of example, with reference to the accompanying drawing, which is a block diagram flow chart of the method of this invention.

DESCRIPTION OF THE PREFERRED EMBODIMENTS

Figure 1:
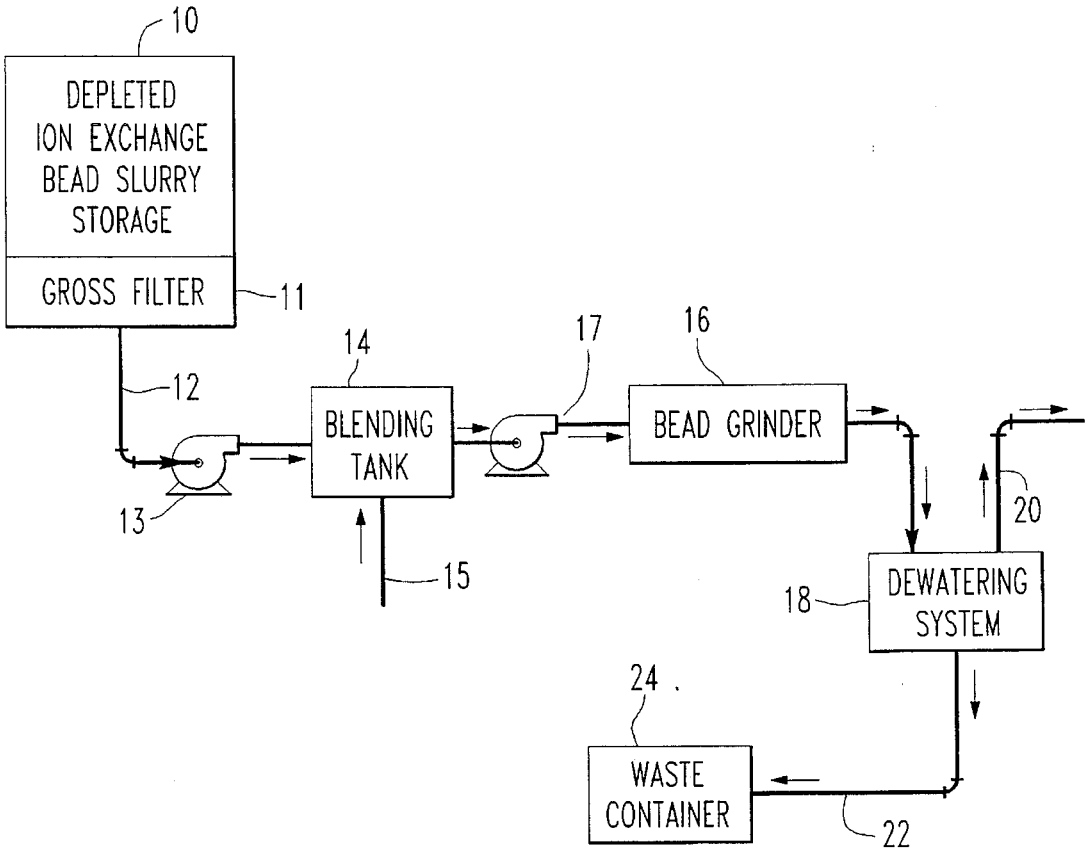

Referring now to the drawing, a storage tank for a contaminated, depleted ion exchange resin bead slurry feed is shown as 10. This slurry feed can contain from 5 weight % to 70 weight % solids and may originate at a nuclear reactor power plant, hospital or any other governmental or commercial operation where ion exchange beads are utilized to capture contaminants. The slurry feed could also originate in any facility to remove ionic and dissolved impurities in a liquid media, as in water filtration plants and the like.

The method of this invention is particularly applicable to a slurry feed containing at least 10 volume % of depleted ion exchange resin beads, and is particularly advantageous for contents of 20 volume % to 70 volume % of resin beads based on total solids content. These beads have a particle size range from 300 micrometers to 1000 micrometers diameter. Most commonly, nuclear grade resin beads have an average particle size of about 400 to 600 micrometers diameter and we have found that they are of generally uniform spherical shape such that 50%, that is at least one half (½) of the number of the beads are within ±10% from the average particle size of the beads taken as a whole. Therefore, if the average diameter of the beads is 500 micrometers, at least one half of the beads will be in the range of 450 to 550 micrometers. The packing factor or efficiency for these beads was found to be not much more than 0.52—the same as a simple cubic pack, which resists volume reduction. By packing factor is meant the volume of the spheres divided by the cell volume enclosing the spheres and is a reflection of packing density. Body centered cubic lattices have packing factors of 0.68, face centered cubic lattices have packing factors of 0.74, and hexagonal close parked lattices have packing factors of 0.74. Other components of the slurry feed can include ion exchange resin powder, soil, and the like, all of which are easily compressible to volume reductions of 25 volume %.

In ion exchange, a solid phase contains bound groups that carry an ionic charge, either positive or negative, in conjunction with free ions of opposite charge that can be displaced. Most ion exchangers currently in large-scale use are based on synthetic resins, for example polystyrene copolymerized with divinylbenzene (to provide the requisite amount of cross linking), and they are permeable only at molecular dimensions, except when a network of coarser pores is deliberately superimposed. Cation-exchange resins can contain bound sulfonic acid groups; less commonly, these groups are carboxylic, phosphonic, phosphinic, etc. Anionic resins can contain quaternary ammonium groups (strongly basic) or other amino groups (weakly basic). Of the two types, the cross linked cation exchange resins are more difficult to process in the grinding step of this invention.

Useful resinous materials effective to attract metal cations generally have structures such as a sulfonated, polystyrene divinyl benzene (strong acid); carboxylic acrylics (weak acid); quaternary ammonium gels (strong base); or a polystyrene-polyamine (weak base). In addition, a chelating functionality group may be incorporated into the resin to produce a greater affinity for metals.

Any ion exchange bead resin that can capture radionucleides; cationic materials having an atomic weight greater than 22, for example, Na, Mg, Al, Ca, Mn, Co, Ni, Rb, Sr, Zr, Mo, Pb; or anionic materials such as bicarbonate, carbonate, hydroxide, sulfate, chloride, nitrate, phosphate and silica, can benefit from the resin grinding of the invention to better insure volume reduction. Of particular interest as an ion exchange feed are those having nuclear grade properties, such as those sold under the Tradename PUROLITE NRW-100, NRW-600 and NRW-37, of strong acid/cation gel, strong base/anion gel, and mixed bed strong acid gel/strong base gel, respectively.

The slurry feed 10, containing the ion exchange resin beads and other solid components is preferably filtered in gross filter 11, to remove any hard objects that could harm grinder blades, and then transferred through piping 12 by pump 13 to blending tank 14. The blending tank will also receive an amount of water to insure a somewhat consistent volume of resin beads into the grinder 16. There should be a steady amount of resin beads solids, rather than an erratic flow of dilute feed followed by very viscous feed so that grinding can be consistent. The blending tank is preferably agitated as by stirring to help provide a homogeneous slurry feed into the grinder. The blending tank volume can range from about 757 liters (200 gal.) to about 15,120 liters (4000 gal). The process can be run continuously, or as a batch operation where the feed is periodically fed from tank 10 to tank 14. Preferably, the concentration of resin beads into the grinder will vary from about 30 volume % to about 50 volume % as determined from a variety of factors, such as whether the beads are the harder to process cation type beads.

The homogeneous slurry from the blending tank is then passed into bead grinder 16. Pump 17 is a variable speed positive displacement pump to ensure feedrate control. The grinder will be in an enclosure to contain and eliminate all potential for airborne contamination and will operate in a manner effective to provide a processed slurry with fractured ion exchange beads having a particle size distribution of from 10 micrometers to 1000 micrometers diameters, preferably from 100 micrometers to 300 micrometers diameter.

Grinding the beads to below 10 micrometers would interfere with efficient dewatering.

It is important that no more than 33% of the fractured beads in the processed slurry have a relatively similar diameter, that is no more than about one third (⅓) of the number of fractured beads are within ±10% of the average particle size of the fractured beads taken as a whole. Therefore, if the average ground particle size is 200 micrometers, not more than one third of the fractured beads will be in the range of 180 to 220 micrometers. Ideally there will be an even distribution within the preferred range between 100 micrometers and 300 micrometers, with, for example, 10% at 100 micrometers, 10% at 120 micrometers and so on, as this would allow close random packing, allowing packing factors from 0.62 to 0.93. Other components of the processed slurry will also be ground finer but that is of minor importance to this invention which is mainly concerned with providing a compressible particle size range for the normally incompressible ion exchange beads. The grinding means can be of any type with an adjustable gap or grinding setting that can handle both high and low solid slurries of plastic like materials in a continuous fashion. Once the beads are ground the water coating on the fractured particles still serves to cause repelling action between the particles and such water must now be removed.

The dewatering system can be of any type but is preferably of the type which includes a shell for providing primary containment for the slurry compression means in the shell and surrounding the slurry for compressing fluid from the slurry, filter means disposed in the shell for containing the slurry and for filtering the fluid compressed from the slurry, and vacuum means connected to the filter means for suctioning the fluid from the filter means and for producing a pressure differential across the compression means and for collapsing the compression means about the filter means and the slurry for compressing the slurry. U.S. Pat. No. 5,143,615 (Roy et al.), herein incorporated by reference, can be referred to for a complete description if such a dewatering system. Compressing dewatering alone can allow about a 5 volume % reduction, but when used in conjunction with prior grinding, the total effect can be a 20 volume % reduction, or higher.

After dewatering, the effective result of this invention will be an approximate 20 volume % reduction in the final waste volume or an approximate 20 weight % increase of spent bead resin in a standard waste container. The process provides: minimal material hold-up to reduce radiation exposure to operating personnel; a totally enclosed, liquid slurry grinding process which eliminates all potential for airborne contamination; a process capable of handling wide swings in process flow rate and slurry concentration as are typically seen in nuclear plant radwaste transfer systems; and a process which minimizes the generation of particles <10 micrometers which would interfere with efficient dewatering. Water or other fluid recovered in the dewatering process can be fed through line 20 for further processing. The compressed material, including dewatered, contaminated, depleted, fractured, ion exchange resin beads and other components, can be fed through line 22 to a suitable waste container system 24.

I claim:

1. A process of reducing the volume of contaminated, depleted ion exchange resin beads, where a substantial amount of the beads have a relatively similar diameter, by contacting the beads with an amount of water effective to maintain a steady, predetermined volume % concentration range of resin beads and provide a homogeneous slurry, and then feeding the slurry to a grinder and grinding the slurry to provide a wide particle size distribution of fractured beads where no more than 33% of the fractured beads in the slurry have a relatively similar diameter, and then dewatering the slurry.

2. A process of reducing the volume of a solids feed, containing contaminated, depleted ion exchange resin beads, comprising the steps of:

(a) transferring a feed slurry containing at least 10 volume % of contaminated, depleted ion exchange resin beads, having a particle size range from 300 micrometers to 1000 micrometers diameter, where at least 20% of the beads in the slurry have a relatively similar diameter, to a blending tank;

(b) feeding an amount of water into the blending tank effective to maintain a steady, predetermined volume % concentration range of resin beads for passage to a grinder to provide a relatively homogeneous slurry;

(c) grinding the slurry including the beads in an enclosure, in a manner effective to contain airborne contamination and to provide a wide particle size distribution of fractured beads, from 10 micrometers to 1000 micrometers diameter, where no more than 33% of the beads in the slurry have a relatively similar diameter, to provide processed slurry and allowing subsequent random packing of the processed slurry at compression; and (d) dewatering the processed slurry.

3. The process of claim 2, where the packing factor of the feed is from 0.50 to 0.60 and the feed is agitated in the blending tank.

4. The process of claim 2, where the packing factor of the ground slurry is from 0.62 to 0.93.

5. The process of claim 2, where the dewatering occurs in a vacuum-compression means which includes a vacuum pump for applying a vacuum to a suitable filter and collapsible membrane combination in which the processed slurry is contained.

6. The process of claim 2, where the contaminated material contained in the depleted ion exchange resin beads are radionuclides.

7. The process of claim 2, where the slurry contains from 5 weight % to 70 weight % solids and from 20 volume % to 70 volume % depleted ion exchange resin beads.

8. The process of claim 2, where the fractured beads, after grinding, will have a particle size range from 100 micrometers to 300 micrometers diameter where no more than one quarter of the number of fractured beads are within ±10% of the average particle size of the fractured beads.

9. The process of claim 2, where the ion exchange resin beads in the slurry prior to grinding are made of copolymerized polystyrene having a generally uniform, spherical shape.

10. The process of claim 2, where the dewatered, processed slurry is disposed of as waste.

* * * * *